US007834562B2

(12) United States Patent
Matsushima

(10) Patent No.: US 7,834,562 B2
(45) Date of Patent: Nov. 16, 2010

(54) DISCHARGE LAMP LIGHTING DEVICE

(75) Inventor: Mitsuo Matsushima, Kitasaku-gun (JP)

(73) Assignee: Minebea Co., Ltd., Kitasaku-gun (JP)

( * ) Notice: Subject to any disclaimer, the term of this patent is extended or adjusted under 35 U.S.C. 154(b) by 315 days.

(21) Appl. No.: 12/086,355

(22) PCT Filed: Oct. 23, 2006

(86) PCT No.: PCT/JP2006/321042

§ 371 (c)(1),
(2), (4) Date: Jun. 11, 2008

(87) PCT Pub. No.: WO2007/069394

PCT Pub. Date: Jun. 21, 2007

(65) Prior Publication Data

US 2010/0213863 A1 Aug. 26, 2010

(30) Foreign Application Priority Data

Dec. 16, 2005 (JP) ..... 2005-363781

(51) Int. Cl.
*G05F 1/00* (2006.01)

(52) U.S. Cl. ..... 315/308

(58) Field of Classification Search ..... 315/219, 315/224, 209 R, 307, 308, DIG. 2, DIG. 3, 315/DIG. 7
See application file for complete search history.

(56) References Cited

U.S. PATENT DOCUMENTS 5,952,791 A * 9/1999 Watanabe et al. ..... 315/225
7,098,609 B2 * 8/2006 Suzuki et al. ..... 315/291
7,233,114 B2 * 6/2007 Lee ..... 315/219
7,598,748 B2 * 10/2009 Hachisuka et al. ..... 324/522
2004/0012381 A1 1/2004 Hachisuka et al.
2004/0012987 A1 1/2004 Hachisuka et al.
2005/0134199 A1 6/2005 Suzuki et al.

FOREIGN PATENT DOCUMENTS

CN 1433131 A 7/2003

(Continued)

*Primary Examiner*—Douglas W. Owens
*Assistant Examiner*—Minh D A
(74) *Attorney, Agent, or Firm*—Oliff & Berridge, PLC

(57) ABSTRACT

To provide a discharge lamp lighting device in which the initial state of discharge in a wiring of a circuit on the secondary side of a transformer in the discharge lamp lighting device is accurately detected and the operation thereof stops and which can be applied to a large-scaled liquid crystal display device. The discharge lamp lighting device according to the present invention includes a transformer 5, a transformer drive circuit 4, and a control circuit 3 for controlling the transformer drive circuit 4. The transformer drive circuit 4 drives the primary side of the transformer 5, and a discharge lamp 6 is lit on by being connected to the secondary side of the transformer 5. The discharge lamp lighting device further includes a discharge detecting pattern 13 having one end connected to the ground and the other end connected to the control circuit 3, and means that detects a voltage induced by electromagnetic waves received by the discharge detecting pattern 13 and stops the power supply to the secondary side of the transformer 5, and at least one part of the discharge detecting pattern 13 is disposed adjacent to a portion of a high-voltage wiring of a circuit on the secondary side of the transformer 5.

6 Claims, 7 Drawing Sheets

FOREIGN PATENT DOCUMENTS

| | | | |
|---|---|---|---|
| CN | 1475809 | A | 2/2004 |
| EP | 1 385 360 | A1 | 1/2004 |
| EP | 1 545 165 | A2 | 6/2005 |
| JP | A 09-129382 | | 5/1997 |
| JP | A 2000-106296 | | 4/2000 |
| JP | A 2002-151287 | | 5/2002 |
| JP | A 2002-341775 | | 11/2002 |
| JP | A 2003-168585 | | 6/2003 |
| JP | A 2004-064910 | | 2/2004 |
| JP | A 2004-135489 | | 4/2004 |
| JP | A 2005-160298 | | 6/2005 |
| JP | A 2005-183099 | | 7/2005 |

* cited by examiner

Prior Art

Prior Art

Prior Art

DISCHARGE LAMP LIGHTING DEVICE

TECHNICAL FIELD

The present invention relates to a discharge lamp lighting device that lights a discharge lamp for illumination of a liquid crystal device, and more particularly, to a discharge lamp lighting device having a function for detecting discharges including corona discharge and arc discharge occurring in a high-voltage circuit wiring of the discharge lamp lighting device.

BACKGROUND ART

A backlight is conventionally used as an illumination device of a liquid crystal display apparatus. For the backlight, a discharge lamp lighting device having a discharge lamp such as a cold cathode lamp or a metal halide lamp and an inverter circuit for lighting-on the discharge lamp is widely used. Since the discharge lamp needs to be lit with a high voltage, a typical discharge lamp lighting device includes a high-voltage transformer that increases an AC voltage generated from the inverter circuit to a high voltage. The discharge lamp is connected to a secondary side of the high-voltage transformer. The discharge lamp lighting device comprises a protecting circuit that stops the operation of the discharge lamp lighting device when lamp current flowing to the discharge lamp is abnormally high, and the protecting circuit is operated upon detection of overcurrent in the discharge lamp so as to prevent the overcurrent to the discharge lamp (refer to, e.g., Patent Document 1).

FIG. 7 shows a block diagram showing the discharge lamp lighting device disclosed in Patent Document 1. Referring to FIG. 7, in a discharge lamp lighting device 50, an H-bridge circuit 52 for driving a primary side of a transformer 51 is connected to the primary side of the transformer 51, and a discharge lamp 54 is connected to the secondary side of the transformer 51. Further, a logic circuit 53 that generates a signal for controlling the operation of the H-bridge circuit 52 is connected thereto. A protecting circuit 55 receives a signal 56 obtained by dividing an output voltage of the secondary side of the transformer 51. When a voltage of the signal 56 is over a preset threshold, the protecting circuit 55 stops the operation of the logic circuit 53, thereby preventing the overcurrent to the discharge lamp 54.

Upon causing disconnection between a wiring and a terminal on the secondary side of the high-voltage transformer, cutting of the wiring on the secondary side of the high-voltage transformer, disconnection between high-voltage connector terminals for connecting the discharge lamp, the presence of defective wiring of the discharge lamp, or reduction in withstand voltage due to defective covering of a coil of the high-voltage transformer, when an interval (distance) between disconnection positions in the high-voltage wiring circuit is narrow, discharge such as corona discharge or arc discharge can occur at any of the positions. In discharge, there is a problem that sparks due to, e.g., arc discharge, may damage the terminal or parts and smoke and fire may damage the discharge lamp lighting device or liquid crystal device. Therefore, the discharge lamp lighting device having the high-voltage transformer needs to detect discharge such as corona discharge or arc discharge and stop the power supply to the discharge lamp and prevent damage to the discharge lamp lighting device and the liquid crystal display device when the discharge occurs.

However, in the discharge lamp lighting device 50 shown in FIG. 7, even if the discharge such as corona discharge or arc discharge occurs at the partly disconnected position of the wiring on the secondary side of the transformer 51, the discharge lamp 54 is in the lit state and lamp current is constant. Therefore, the voltage of the signal 56 is not over the preset threshold and the protecting circuit 55 is not thus operated. As a consequence, there is a problem that the occurrence of discharge such as corona discharge or arc discharge is not detected.

Then, it is proposed that such a discharge lamp lighting device detects the initial state of corona discharge occurring near the high-voltage transformer and the discharge lamp and protect the circuit (refer to, e.g., Patent Document 2). The Patent Document 2 discloses that, upon the occurrence of corona discharge near the high-voltage transformer or lamp (discharge lamp), an induction pattern for the transformer and an induction pattern for the lamp disposed on a printed circuit board detect the initial state of the corona discharge and protect the circuit, an inverter circuit being protected upon detection of a voltage induced in the induction patterns.

FIG. 8 shows a block diagram showing the discharge lamp lighting device disclosed in Patent Document 2. A discharge lamp lighting device 60 shown in FIG. 8 comprises a rectangular induction-pattern portion 62 for a transformer on the bottom surface of a printed circuit board corresponding to a high-voltage transformer 61, and a rectangular induction pattern portion 64 for a lamp on the bottom surface of the printed circuit board corresponding to a lamp 63. Upon the occurrence of the corona discharge in the high-voltage transformer 61 or the lamp 63, corona-discharge detecting circuits 65 and 66 detect high-frequency voltages induced in the induction pattern portions 62 and 64, and stop switching transistors 67 and 68, thereby protecting the discharge lamp lighting device 60.

Further, such a discharge lamp lighting device is proposed that, upon the occurrence of discharge in the wiring on the secondary side of the high-voltage transformer in the discharge lamp lighting device, the discharge is detected and operation of the discharge lamp lighting device is stopped, it being inexpensive to apply such a discharge lamp lighting device to a large-scale liquid crystal display device (refer to, e.g., Patent Document 3).

FIG. 9 is a block diagram showing the discharge lamp lighting device disclosed in Patent Document 3. Referring to FIG. 9, in a discharge lamp lighting device 70, a discharge lamp 76 is connected to one end thereof on the secondary side of a high-voltage transformer 75. Further, a current/voltage converting circuit 77 for converting lamp current into a voltage and a pattern 78 for controlling lamp current are disposed on the other end of the discharge lamp 76, and a discharge detecting pattern 79 adjacent to and in parallel with the pattern 78 for controlling the lamp current is disposed on the GND on the secondary side of the high-voltage transformer 75. A voltage induced in the discharge detecting pattern 79 is detected and the power supply to the secondary side of the high-voltage transformer 75 is stopped, thereby protecting the discharge lamp lighting device 70.

Patent Document 1: Japanese Unexamined Patent Application Publication No. 2003-168585

Patent Document 2: Japanese Unexamined Patent Application Publication No. 2002-341775

Patent Document 3: Japanese Unexamined Patent Application Publication No. 2005-183099

DISCLOSURE OF INVENTION

However, the discharge lamp lighting device disclosed in Patent Document 2 is formed onto a printed circuit board with the same size as a light guide panel arranged to the bottom surface of a liquid crystal cell. Thus, a large-scaled liquid crystal device, typically for example, a liquid crystal display TV, has a problem that a large-scaled printed circuit board is required for the large-scaled liquid crystal cell and the price of the discharge lamp lighting device is consequently high.

Further, since the induction pattern portions are required for the transformer and the lamp, there is a problem that the price of the discharge lamp lighting device is high. In particular, the discharge lamp lighting device for the large-scaled liquid crystal device uses a plurality of lamps and a plurality of transformers. Therefore, a plurality of the induction pattern portions 62 for the transformer and a plurality of induction pattern portions 64 for lamp need to be formed. There is a problem that the price of the discharge lamp lighting device is high and the induction pattern portions cannot be arranged.

Furthermore, with the discharge lamp lighting device disclosed in Patent Document 3, a high-frequency noise multiplexed to the lamp current is detected by the discharge occurring in the high-voltage wiring circuit. The discharge detecting pattern 79 is disposed adjacently in parallel with the pattern 78 for controlling the lamp current connected to a low-voltage (the other end) side of the discharge lamp 76. As a consequence, the high-frequency noise is easily attenuated and the sensitivity for detecting the discharge such as corona discharge or arc discharge thus deteriorates. There is a problem that the discharge cannot be detected depending on the discharge condition.

The present invention is devised in consideration of the problems. It is an object of the present invention to provide a discharge lamp lighting device in which, upon causing the discharge such as corona discharge or arc discharge in a circuit wiring on the secondary side of a transformer in the discharge lamp lighting device, the initial state of the discharge is precisely detected and the operation thereof stops it is inexpensive for a large-scaled liquid crystal display device.

MEANS FOR SOLVING THE PROBLEMS

In order to accomplish the object, a discharge lamp lighting device according to the present invention comprises: a transformer; a transformer drive circuit; and a control circuit for controlling the transformer drive circuit. The transformer drive circuit drives the primary side of the transformer, and a discharge lamp is lit on by being connected to the secondary side of the transformer. Further, one end of the secondary side of the transformer is connected to one end of the discharge lamp through a connector while the other end of the secondary side of the transformer is connected to the ground. Still further, the discharge lamp lighting device further comprises: a discharge detecting pattern having one end connected to the ground and the other end connected to the control circuit; and means that detects a voltage induced by electromagnetic waves received by the discharge detecting pattern and stops the power supply to the secondary side of the transformer. Moreover, the discharge detecting pattern partially includes a wave-shaped portion, and at least one part of the discharge detecting pattern is disposed adjacent to a portion ranging from a terminal of the secondary side of the transformer to the connector.

According to the present invention, at least one part of the discharge detecting pattern having one end connected to the ground and the other end connected to the control circuit is disposed adjacent to the portion of the high-voltage wiring of the circuit on the secondary side of the transformer. Therefore, the discharge detecting pattern is used as an antenna and directly receives electromagnetic waves occurring by the discharge such as the corona discharge or arc discharge without fail, thereby precisely detecting the initial state of the discharge. Thus, the operation of the discharge lamp lighting device stops by the means that detects the voltage induced to the discharge detecting pattern and stops the power supply to the secondary side of the transformer upon causing the discharge such as corona discharge or arc discharge, thereby protecting the discharge lamp lighting device. In this case, the structure in which one end of the discharge detecting pattern is connected to the ground is advantageous in terms of high degree of freedom of the wiring on the design of the discharge detecting pattern.

In addition, generally, the corona discharge or arc discharge easily occurs particularly at the portion ranging from the terminal on the secondary side of the transformer to the connector of the high-voltage wiring portion in the circuit on the secondary side of the transformer. Therefore, at least one part of the discharge detecting pattern is disposed adjacent to the portion ranging the terminal on the secondary side of the transformer to the connector, thereby further accurately detecting the initial state of the discharge.

Moreover, the discharge detecting pattern may be waveshape so that the inductance of the discharge detecting pattern is set to an arbitrary proper value and electromagnetic waves occurring by the corona discharge or arc discharge are detected with high sensitivity.

In addition, the discharge detecting pattern may be formed on a surface opposite an attaching surface of the transformer on the printed circuit board. As a consequence thereof, the discharge detecting pattern is easily disposed adjacent to the high-voltage wiring portion of the circuit on the secondary side of the transformer, preferably, the portion ranging from the terminal on the secondary side of the transfer to the connector. This structure is advantageous to dispose the discharge detecting pattern near a plurality of transformers and a plurality of connectors included in, particularly, the discharge lamp lighting device that lights a plurality of discharge lamps. Thus, the discharge lamp lighting device according to the present invention can be applied to a large-scaled liquid crystal display device with low costs.

ADVANTAGES

With the above-mentioned structure, the present invention can provide a discharge lamp lighting device, in which the initial state of discharge such as corona discharge or arc discharge in the wiring of the circuit on the secondary side of the transformer in the discharge lamp lighting device is accurately detected and the operation thereof stops and which can be applied to a large-scaled liquid crystal display device with low costs.

REFERENCE NUMERALS

Figure 1:
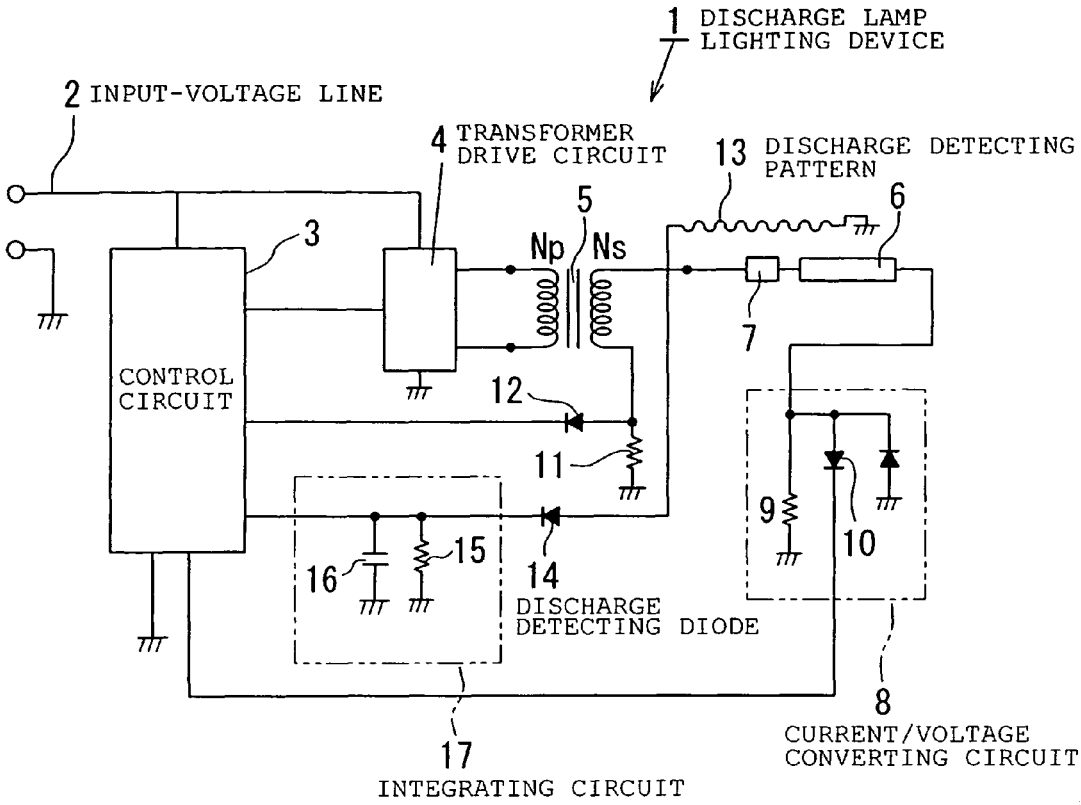
FIG. 1 is a circuit structure diagram showing a discharge lamp lighting device according to the first embodiment of the present invention.

1, 30, 40: discharge lamp lighting device
3: control circuit
4: transformer drive circuit
5: high-voltage transformer
6: discharge lamp
7: high-voltage output connector
13, 13', 13": discharge detecting pattern

BEST MODE FOR CARRYING OUT THE INVENTION

Hereinbelow, a description will be given of embodiments of the present invention with reference to the drawings. FIG. 1 is a circuit structure diagram showing a discharge lamp lighting device according to the first embodiment of the present invention.

A discharge lamp lighting device 1 shown in FIG. 1 comprises: a high-voltage transformer 5; a transformer drive circuit 4 connected to a primary side Np of the high-voltage transformer 5; and a control circuit 3 connected to the transformer drive circuit 4. A discharge lamp 6 comprising a cold cathode lamp is connected to the secondary side Ns of the high-voltage transformer 5. In the discharge lamp lighting device 1, one end of the secondary side Ns of the high-voltage transformer 5 is connected to one end of the discharge lamp 6 via a high-voltage output connector 7, and the other end of the secondary side Ns of the high-voltage transformer 5 is connected to the ground (GND) via a resistor 11 for detecting overcurrent. Further, the other end of the discharge lamp 6 has a current/voltage converting circuit 8.

Herein, the control circuit 3 has an oscillation circuit (not shown) that sets a drive frequency of the transformer drive circuit 4. In the discharge lamp lighting device 1, the transformer drive circuit 4 drives the primary side Np of the high-voltage transformer 5 on the basis of a control signal outputted from the control circuit 3, thereby lighting the discharge lamp 6 connected to the secondary side Ns of the high-voltage transformer 5.

Figure 7:
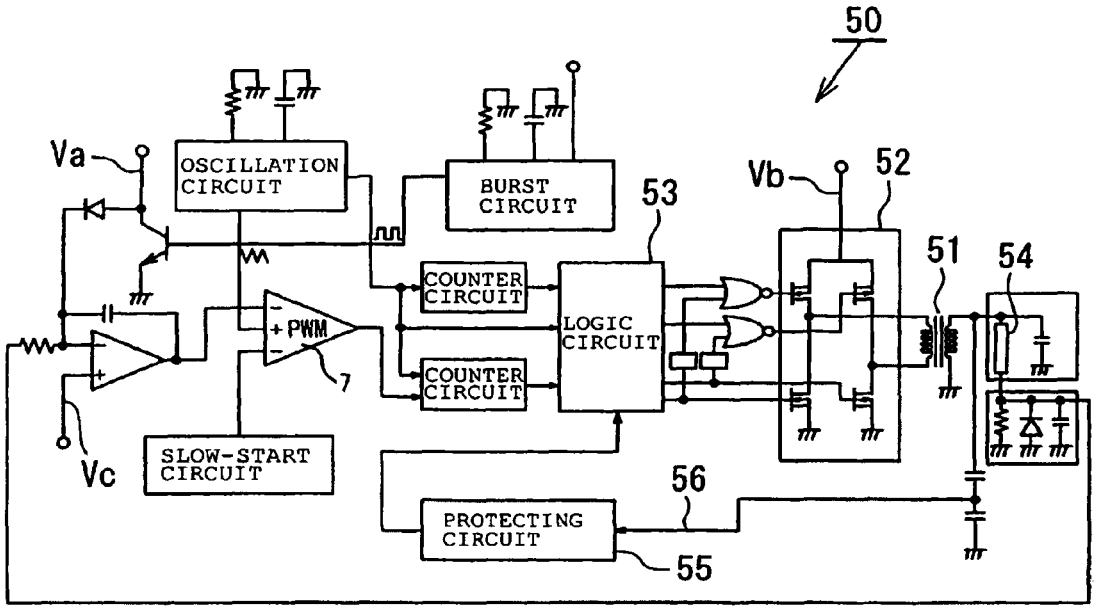
FIG. 7 is a block diagram showing one example of a circuit structure of a discharge lamp lighting device according to a conventional art.
Figure 8:
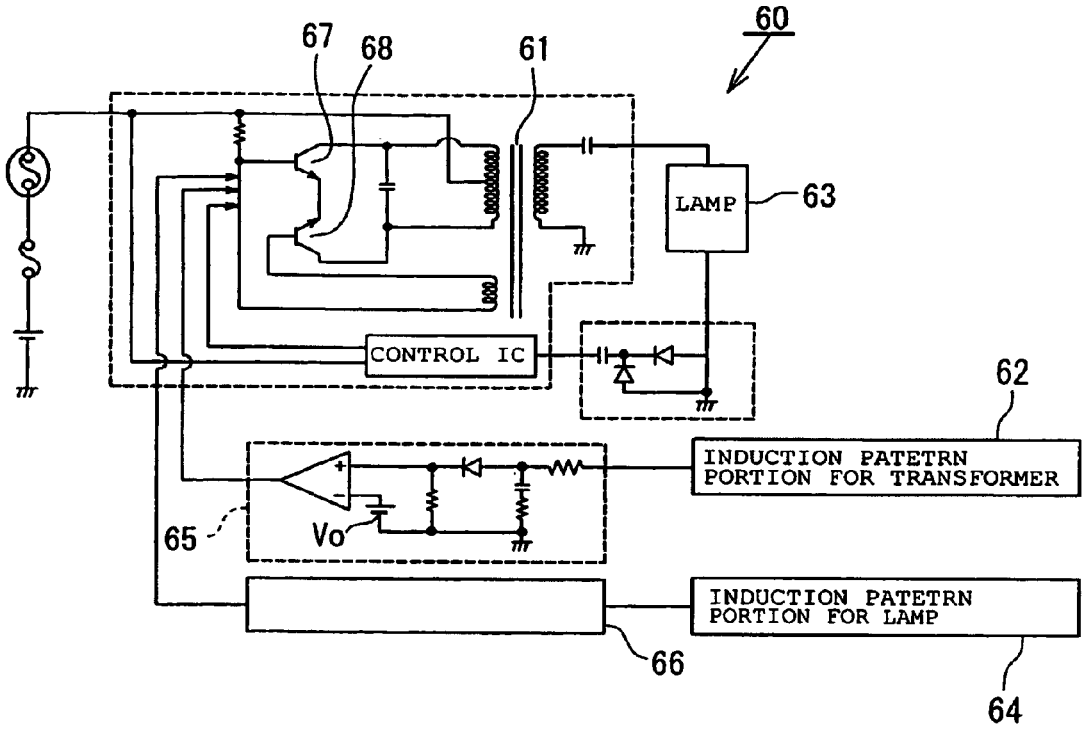
FIG. 8 is a block diagram showing another example of the circuit structure of the discharge lamp lighting device according to the conventional art.
Figure 9:
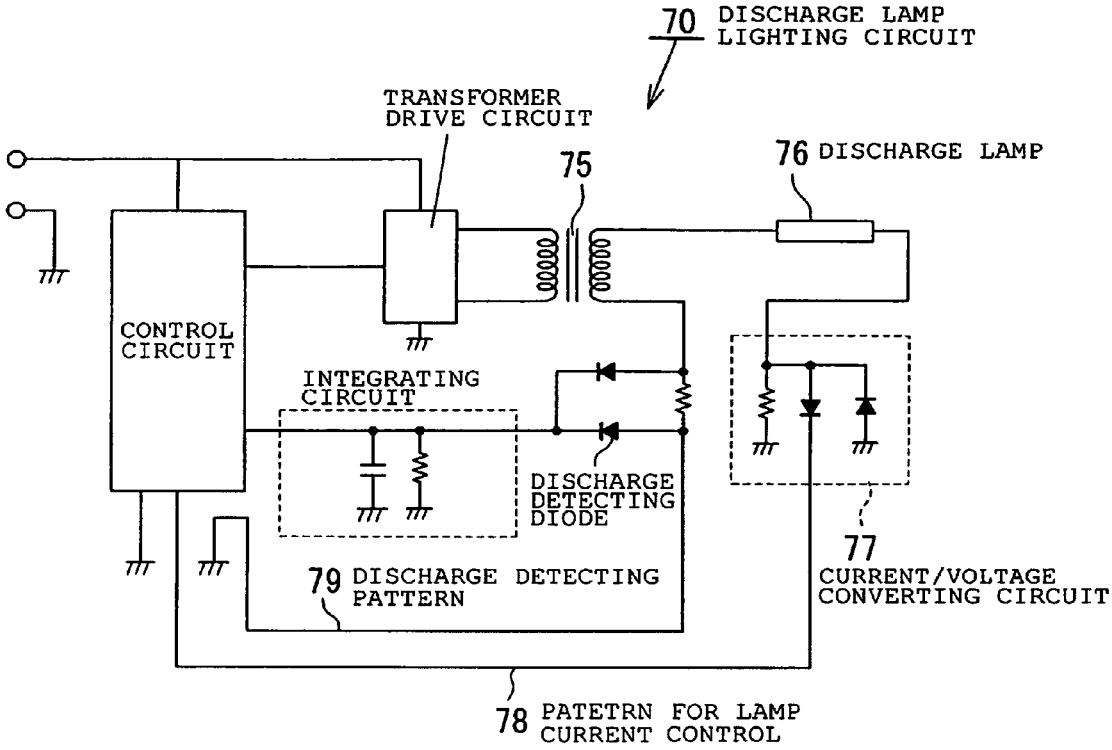
FIG. 9 is a block diagram showing another example of the circuit structure of the discharge lamp lighting device according to the conventional art.

Preferably, the transformer drive circuit 4 is an H-bridge circuit having four switching elements similar to the H-bridge circuit 52 shown in FIG. 7. In this case, an output signal from the control circuit 3 is a gate signal that controls on/off-operation of the switching elements. The transformer drive circuit 4 converts a DC voltage supplied from an input-voltage line 2 into an AC voltage by switching the four switching elements at a predetermined timing, thereby driving the primary side Np of the high-voltage transformer 5. The high-voltage transformer 5 increases the AC voltage applied to the primary side Np and outputs the voltage to the secondary side Ns, thereby lighting the discharge lamp 6 with the increased output voltage.

Incidentally, the transformer drive circuit 4 according to the first embodiment is not limited to the H-bridge circuit, and can use an arbitrary proper circuit having a switching element for driving the primary side Np of the high-voltage transformer 5, such as a half-bridge circuit having two switching elements.

In the current/voltage converting circuit 8, a resistor 9 for detecting lamp current converts lamp current into a voltage, and an output signal therefrom is inputted to the control circuit 3 via a diode 10. The control circuit 3 controls the transformer drive circuit 4 in accordance with the output signal from the current/voltage converting circuit 8 so as to set lamp current flowing to the discharge lamp 6 to be constant.

Further, current flowing to the secondary side Ns of the high-voltage transformer 5 is converted into a voltage by the resistor 11, and an output signal therefrom is inputted to the control circuit 3 via a diode 12. When the output signal from the diode 12 is over a preset reference voltage, the control circuit 3 stops the operation of the transformer drive circuit 4, thereby preventing the overcurrent in the discharge lamp 6.

The discharge lamp lighting device 1 according to the first embodiment comprises a discharge detecting pattern 13, one end thereof being connected to the ground, and the other end thereof being connected to the control circuit 3 via a discharge detecting diode 14. According to the first embodiment, the discharge detecting pattern 13 includes a sine-wave portion that is disposed adjacent to a portion from the terminal on the secondary side Ns of the high-voltage transformer 5 to a high-voltage output connector 7, of a high-voltage wiring portion of the circuit on the secondary side of the high-voltage transformer 5.

With regard to the discharge lamp lighting device 1 having the above-mentioned structure, a description will be given of means that detects a voltage induced in the discharge detecting pattern 13 and stops the power supply to the secondary side of the high-voltage transformer 5 and an operation for detecting discharge.

In general, corona discharge or arc discharge results in radiation of electromagnetic waves including a high-frequency component. When corona discharge or arc discharge occurs at a partly disconnected portion of the circuit on the secondary side of the high-voltage transformer 5, the discharge detecting pattern 13 functions as a receiving antenna of the electromagnetic waves radiated as a result of the discharge, thereby generating an induction voltage in the discharge detecting pattern 13. The induction voltage is received by a comparing circuit (not shown) included in the control circuit 3 via an integrating circuit 17 comprising a resistor 15 and a condenser 16 through the discharge detecting diode 12, and is compared with a preset reference voltage by the comparing circuit.

When the voltage signal received from the integrating circuit 17 is over the reference voltage, the control circuit 3 outputs a stop signal from the comparing circuit, thereby stopping the operation of an oscillation circuit (not shown) included in the control circuit 3. As a consequence, the operation of the transformer drive circuit 4 stops and the power supply to the secondary side of the high-voltage transformer 5 thus stops. Hence, the continuation of the corona discharge or arc discharge occurring in the circuit on the secondary side of the high-voltage transformer 5 stops, thereby protecting the discharge lamp lighting device 1.

In the operation for detecting the discharge, with the discharge lamp lighting device 1 according to the first embodiment, at least the wave-shaped portion of the discharge detecting pattern 13 is disposed adjacent to the high-voltage wiring portion in the circuit on the secondary side of the high-voltage transformer 5, thereby directly receiving the electromagnetic waves radiated as a result of the discharge with high accuracy. Further, at a portion ranging from the terminal on the secondary side Ns of the high-voltage transformer 5 to the high-voltage output connector 7, corona discharge or arc discharge occurs particularly easily. Therefore, it is possible to accurately detect the initial state of the discharge occurring at the high-voltage wiring portion in the circuit on the secondary side of the high-voltage transformer 5.

In this case, preferably, the discharge detecting pattern 13 is disposed adjacent to the high-voltage transformer 5 and the high-voltage output connector 7, or a wiring pattern for connecting the high-voltage transformer 5 and the high-voltage output connector 7 as much as possible. Thus, it is possible to suppress the effect of the reduction in strength of the electrical field of the electromagnetic waves radiated as a result of the discharge, and it is then possible to improve the detecting sensitivity of the discharge.

Next, a description will be given of a discharge lamp lighting device according to the second embodiment of the present invention. The discharge lamp lighting device according to the second embodiment comprises a plurality of high-voltage transformers and a plurality of high-voltage output connectors, and lights a plurality of discharge lamps connected to the high-voltage output connectors. The discharge lamp lighting device according to the second embodiment can be realized by an arbitrary proper structure in which a plurality of high-voltage transformers serially-connected are connected to the transformer drive circuit 4 or a plurality of high-voltage transformers are connected to the transformer drive circuit 4 in parallel therewith in the discharge lamp lighting device 1 shown in FIG. 1. The features according to the present invention are not obtained by specific realizing means. Therefore, the following description will be given of only the structure of a discharge detecting pattern and a relating portion thereof as the feature according to the present invention.

Figure 2:
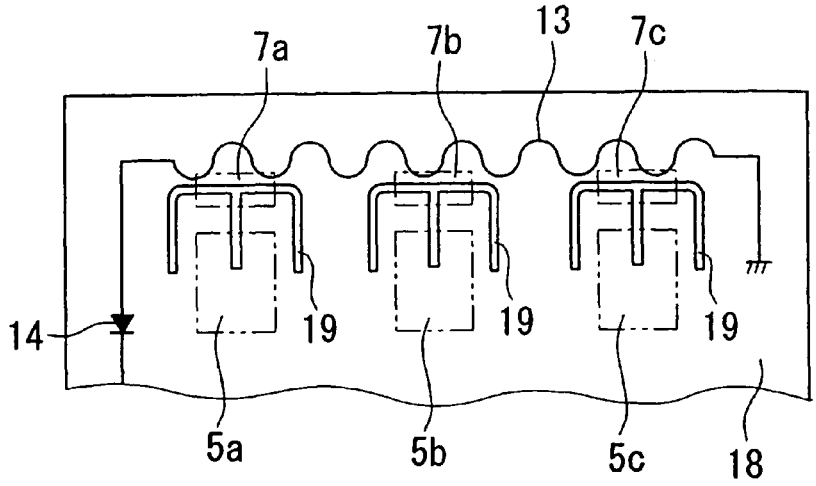
FIG. 2 is a plan view showing a structure example of a discharge detecting pattern in a discharge lamp lighting device according to the second embodiment of the present invention.

FIG. 2 is a plan view in which a printed circuit board 18 having a plurality of (three in the example in the drawing) high-voltage transformers 5*a* to 5*c* and a plurality of (three in the example in the drawing) high-voltage output connectors 7*a* to 7*c* is viewed from the surface (hereinbelow, referred to as a rear surface) opposite an attaching surface of the high-voltage transformers 5*a* to 5*c* and the high-voltage output connectors 7*a* to 7*c*. Referring to FIG. 2, portions corresponding to the attaching portion of the high-voltage transformers 5*a* to 5*c* and portions corresponding to the attaching portions of the high-voltage output connectors 7*a* to 7*c* are represented by reference numerals, as rectangular areas shown by dashed-two dotted lines. On the printed circuit board 18, terminals on the secondary side of the high-voltage transformers 5*a* to 5*c* are disposed on the opposite sides (upper side in FIG. 2) of the corresponding high-voltage output connectors 7*a* to 7*c*. The printed circuit board 18 has slits 19 for ensuring the creeping distance between parts in the circuit on the secondary side of the high-voltage transformers 5*a* to 5*c* and for improving the withstand voltage.

According to the second embodiment, the discharge detecting pattern 13 is formed to the rear surface of the printed circuit board 18, and a portion formed with a sine wave is disposed to pass near the portions (rectangular areas 7*a* to 7*c* shown by the dashed-two dotted lines in FIG. 2) corresponding to the attaching portions of the high-voltage output connectors 7*a* to 7*c* or therethrough. Thus, the discharge detecting pattern 13 is disposed adjacent to, particularly, the high-voltage output connectors 7*a* to 7*c* of the portion ranging from the terminals on the secondary side of the high-voltage transformers 5*a* to 5*c* to the high-voltage output connectors 7*a* to 7*c*.

With the above-mentioned structure, when the corona discharge or arc discharge occurs at the partly-disconnected portion of the circuit on the secondary side of the high-voltage transformers 5*a* to 5*c*, the discharge detecting pattern 13 shown in FIG. 2 detects the radiation of electromagnetic waves in accordance with the discharge with high sensitivity and further detects the initial state of the discharge with high accuracy.

Figure 3:
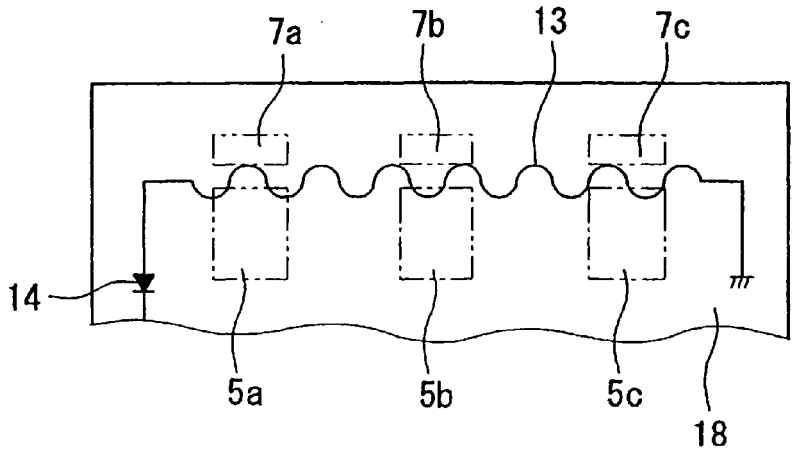
FIG. 3 is a plan view showing another structure example of the discharge detecting pattern in the discharge lamp lighting device according to the second embodiment of the present invention.

FIG. 3 shows another structure example of the discharge detecting pattern according to the second embodiment. A printed circuit board 18 shown in FIG. 3 is similar to the printed circuit board 18 shown in FIG. 2 and is however different from that shown in FIG. 2 because the slit 19 for ensuring the creeping distance is not provided.

In this case, the discharge detecting pattern 13 formed to the rear surface of the printed circuit board 18 is disposed at the intermediate position between the portions (rectangular areas 5*a* to 5*c* shown by dashed-two dotted lines in FIG. 3) corresponding to the attaching portions of the high-voltage transformers 5*a* to 5*c* and the portions (rectangular areas 7*a* to 7*c* shown by dashed-two dotted lines in FIG. 3) corresponding to the attaching portions of the high-voltage output connectors 7*a* to 7*c* so as to pass near both the portions 5*a* to 5*c* and 7*a* to 7*c*.

With the discharge detecting pattern shown in FIG. 3, the portion ranging the terminals on the secondary side of the high-voltage transformers 5*a* to 5*c* to the high-voltage output connectors 7*a* to 7*c* is disposed adjacent to both the terminals on the secondary side of the high-voltage transformers 5*a* to 5*c* and the high-voltage output connectors 7*a* to 7*c*. Therefore, as compared with the structure shown in FIG. 2, the initial state of the discharge can be detected with high accuracy.

Herein, the connection of the discharge detecting pattern is not limited to that shown in FIG. 1. As a discharge lamp lighting device 30 according to the third embodiment of the present invention shown in FIG. 4, one end on the ground side of a discharge detecting pattern 13' may be connected to a low-voltage side of the resistor 11 arranged to the ground side of the secondary side Ns of the high-voltage transformer 5, and the other end thereof may be connected to the control circuit 3 via the discharge detecting diode 14, similarly to the discharge detecting pattern 13 shown in FIG. 1.

Figure 5:
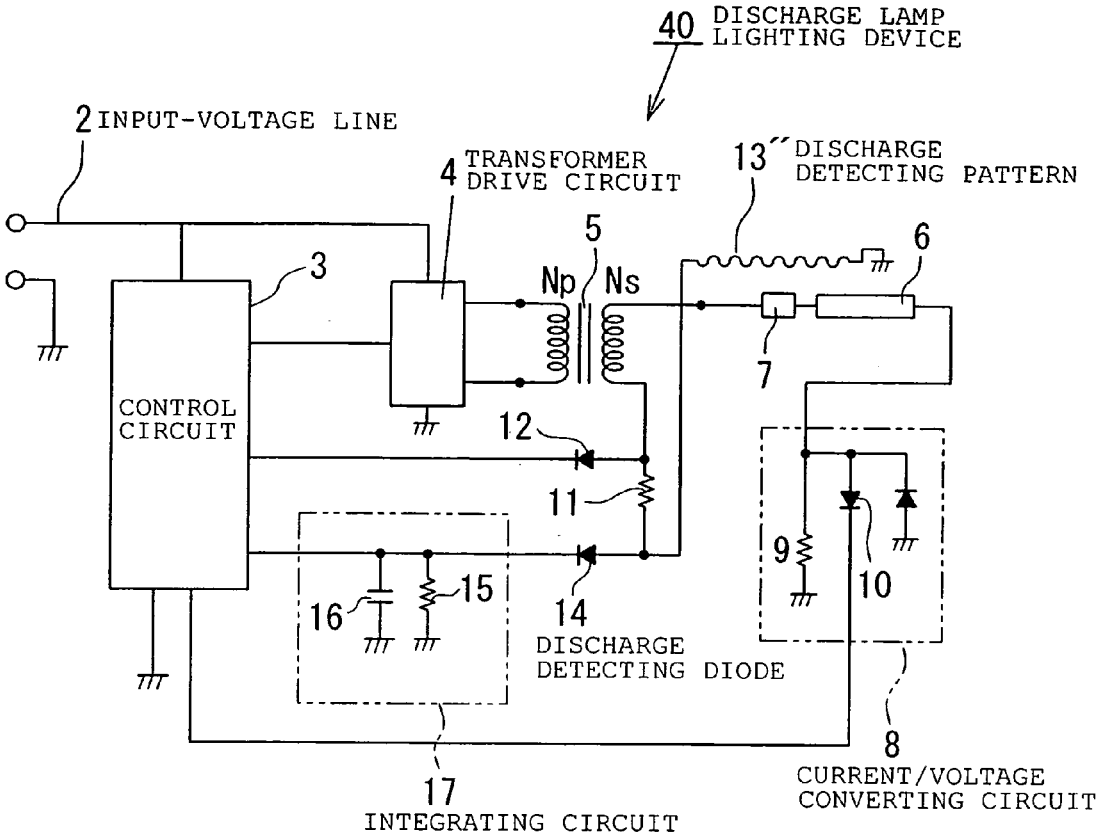
FIG. 5 is a circuit structure diagram showing a discharge lamp lighting device according to the fourth embodiment of the present invention.
Figure 6A:
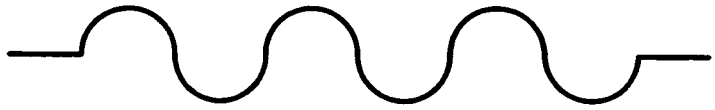
FIG. 6 is a diagram showing shapes of a discharge detecting pattern according to the present invention, (*a*) shows a sine wave, (*b*) shows a triangular wave, (*c*) shows a zigzag wave, and (*d*) shows a squared wave.
Figure 6B:
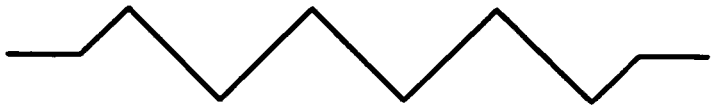
Figure 6C:
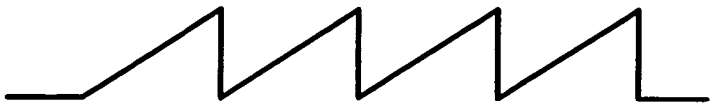
Figure 6D:
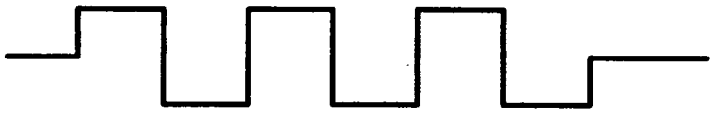

Alternatively, as a discharge lamp lighting device 40 according to the fourth embodiment shown in FIG. 5 according to the present invention, one end of a discharge detecting pattern 13" may be connected to the ground similarly to the discharge detecting pattern 13 shown in FIG. 1, the other end thereof may be connected to the control circuit 3 via the discharge detecting diode 14, and a low-voltage side of the resistor 11 disposed to the ground side of the secondary side Ns of the high-voltage transformer 5 may be connected to the connecting point between the discharge detecting pattern 13" and the discharge detecting diode 14 and may be also connected to the ground via the discharge detecting pattern 13".

Figure 4:
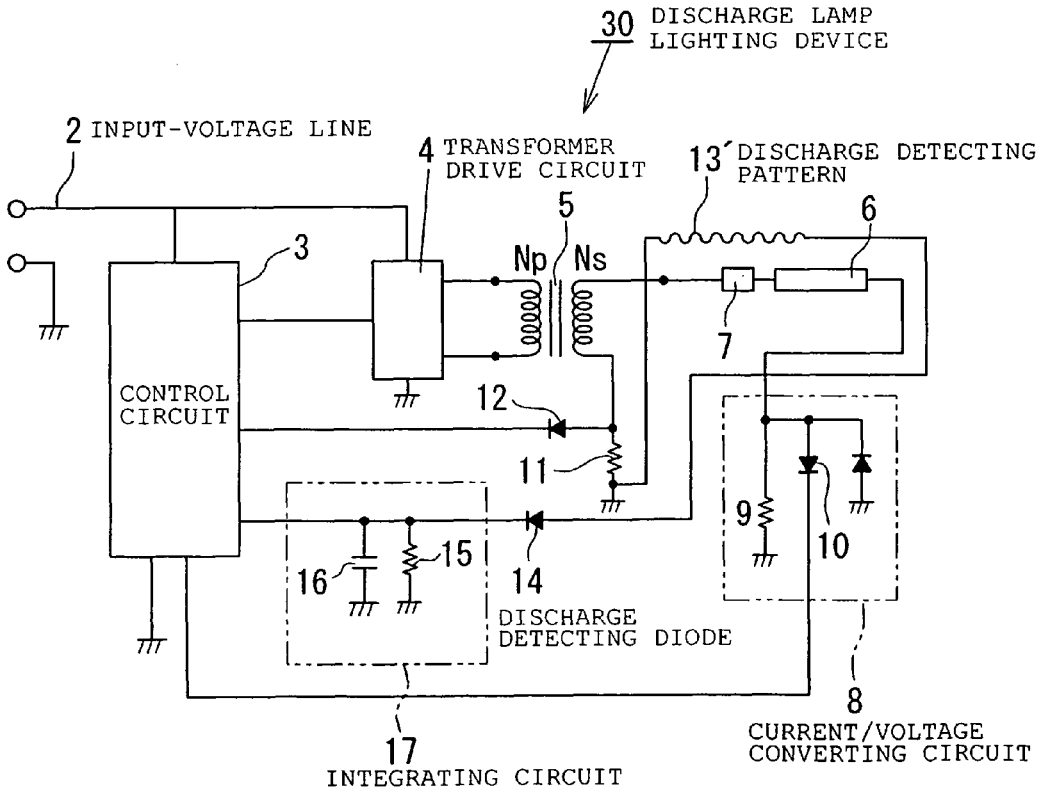
FIG. 4 is a circuit structure diagram showing a discharge lamp lighting device according to the third embodiment of the present invention.

Since the discharge detecting patterns 13' and 13" are formed integrally with the wiring pattern of the secondary side Ns of the high-voltage transformer 5 in the discharge lamp lighting devices 30 and 40 shown in FIGS. 4 and 5, the operation for forming the pattern becomes easy.

With the above description, the discharge detecting patterns 13, 13', and 13" include the portion (refer to FIG. 6(*a*))

formed with the sine wave. However, the discharge detecting pattern according to the present invention may be a linear pattern without including the portion shaped with the wave. Alternatively, the wave-shaped portion may be triangularly shaped as shown in FIG. 6(*b*), may be zigzag-shaped as shown in FIG. 6(*c*), or may be square-shaped as shown in FIG. 6(*d*). Alternatively, the wave-shaped portion may be twist-shaped across both sides of the printed circuit board by using a through-hole disposed to the printed circuit board.

As mentioned above, the shapes of the discharge detecting patterns 13, 13', and 13" are properly designed. As a consequence, it is possible to optimize the inductance of the discharge detecting patterns 13, 13', and 13" depending on characteristics of the electromagnetic waves radiated as a result of the discharge. Therefore, the detecting accuracy of the discharge can be improved.

Further, the disposing positions of the discharge detecting patterns 13, 13' and 13" are not limited to the above embodiments as long as being disposed adjacent to the high-voltage wiring portion of the circuit on the secondary side of the high-voltage transformer 5. For example, upon using a multi-layered printed circuit board for attaching circuitry parts such as the high-voltage transformer 5, the discharge detecting patterns 13, 13' and 13" are embedded into internal layers of the multi-layered printed circuit board, thereby disposing the discharge detecting pattern adjacent to the high-voltage wiring portion.

In addition, three high-voltage transformers are used in FIGS. 2 and 3. However, the present invention can be applied to a discharge lamp lighting device having an arbitrary number of high-voltage transformers and an arbitrary number of high-voltage output connectors while holding the structure having one of the discharge detecting patterns 13, 13', and 13".

The invention claimed is:

1. A discharge lamp lighting device comprising: a transformer; a transformer drive circuit; and a control circuit for controlling the transformer drive circuit, the transformer drive circuit driving a primary side of the transformer, a discharge lamp being lit by being connected to the secondary side of the transformer, wherein:

the secondary side of the transformer has one end and the other end respectively connected to one end of the discharge lamp through a connector and to the ground;

the discharge lamp lighting device further comprises: a discharge detecting pattern having one end connected to the ground and the other end connected to the control circuit; and means that detects a voltage induced by electromagnetic waves received by the discharge detecting pattern and stops the power supply to the secondary side of the transformer;

the discharge detecting pattern partially includes a wave-shaped portion; and at least one part of the discharge detecting pattern is disposed adjacent to a portion ranging from a terminal of the secondary side of the transformer to the connector.

2. The discharge lamp lighting device according to claim 1, wherein one end of the discharge detecting pattern is connected between a resistor connected to the other end of the secondary side of the transformer and the ground, and the other end of the discharge detecting pattern is connected to the control circuit.

3. The discharge lamp lighting device according to claim 2, wherein the discharge detecting pattern is formed on a surface opposite an attaching surface of the transformer on the printed circuit board.

4. The discharge lamp lighting device according to claim 1, wherein one end of the discharge detecting pattern is connected to the ground, and the other end of the discharge detecting pattern is connected to the resistor connected to the other end of the secondary side of the transformer and also to the control circuit.

5. The discharge lamp lighting device according to claim 4, wherein the discharge detecting pattern is formed on a surface opposite an attaching surface of the transformer on the printed circuit board.

6. The discharge lamp lighting device according to claim 1, wherein the discharge detecting pattern is formed on a surface opposite an attaching surface of the transformer on the printed circuit board.

* * * * *